United States Patent [19]

Laemmle

[11] 4,452,711

[45] Jun. 5, 1984

[54] AQUEOUS METALWORKING LUBRICANT CONTAINING POLYOXYPROPYLENE-POLYOXYETHYLENE-POLYOXYPROPYLENE BLOCK COPOLYMERS

[75] Inventor: Joseph T. Laemmle, Delmont, Pa.

[73] Assignee: Aluminum Company of America, Pittsburgh, Pa.

[21] Appl. No.: 459,316

[22] Filed: Jan. 20, 1983

[51] Int. Cl.[3] ..... C10M 3/26

[52] U.S. Cl. ..... 252/49.3; 72/42; 252/34.7; 252/52 A

[58] Field of Search ..... 252/34.7, 49.3, 52 A; 72/42

[56] References Cited

U.S. PATENT DOCUMENTS

| | | | |
|---|---|---|---|
| 2,825,693 | 3/1958 | Beaubien et al. | 252/32.5 |
| 2,981,686 | 4/1961 | Reamer | 252/33.6 |
| 3,006,849 | 10/1961 | Plemich | 252/34.7 |
| 3,036,118 | 5/1962 | Jackson et al. | 200/484 |
| 3,036,118 | 5/1962 | Jackson et al. | 260/484 |
| 3,374,171 | 3/1968 | Davis | 252/34.7 |
| 3,630,898 | 12/1971 | Teeter et al. | 252/34.7 |
| 4,033,886 | 7/1977 | Felton | 252/34.7 |
| 4,113,785 | 9/1978 | Helfert et al. | 252/52 A X |
| 4,243,537 | 1/1981 | Knepp et al. | 252/49.3 |
| 4,250,046 | 2/1981 | Przybylinski | 252/49.3 |
| 4,259,206 | 3/1981 | Piotrowski et al. | 252/49.3 X |
| 4,359,393 | 11/1982 | Sturwold | 252/49.3 X |

FOREIGN PATENT DOCUMENTS

| | | | |
|---|---|---|---|
| 648867 | 9/1962 | Canada | 252/49.3 |
| 833868 | 5/1960 | United Kingdom | 252/49.3 |
| 1091186 | 11/1967 | United Kingdom | 252/34.7 |
| 1093959 | 12/1967 | United Kingdom | 252/34.7 |

OTHER PUBLICATIONS

Kirk-Othmer Ency. of Chem. Tech., vol. 10, 2nd Ed., pp. 658-659, 1966.

*Primary Examiner*—Andrew Metz
*Attorney, Agent, or Firm*—Glenn E. Klepac

[57] ABSTRACT

An aqueous metalworking lubricant composition comprising a water-soluble mixture of polyoxypropylene-polyoxyethylene-polyoxypropylene block copolymers, a water-soluble carboxylic acid, a water-soluble alkanolamine and water. A preferred lubricant composition also comprises an antifoam agent. The lubricant composition is suitable for both cold rolling and hot rolling of metals such as aluminum and aluminum alloys.

20 Claims, No Drawings

AQUEOUS METALWORKING LUBRICANT CONTAINING POLYOXYPROPYLENE-POLYOXYETHYLENE-POLYOXYPROPYLENE BLOCK COPOLYMERS

BACKGROUND OF THE INVENTION

The present invention relates to lubricant compositions and more particularly to water-soluble lubricant compositions suitable for use in metalworking operations such as the cold rolling and hot rolling of aluminum and aluminum alloys.

In the rolling of metals such as aluminum and aluminum alloys, it is customary to flood the rolls and the workpiece with a coolant for the purpose of carrying away heat generated by the operation. It is also customary to employ the coolant in combination with various agents having load bearing and friction-modifying properties for reducing friction between the rolls and the workpiece. It has heretofore been the practice to use for such purpose aqueous compositions containing such lubricating agents as emulsified petroleum and non-petroleum additives. In order to perform satisfactorily on an industrial scale, and aqueous lubricant fluid must meet several important requirements.

Among the requirements for a satisfactory metalworking lubricant are corrosion-inhibiting properties and stability under conditions of operation. While various fluids may possess such characteristics, there are also other important requirements that should be met. Among these requirements is the avoidance of deposits on the rolls and workpiece following the rolling operation. Such deposits result from drying of the fluid, and they are difficult to remove. Other important requirements include avoidance of excessive foam formation. Metalworking lubricants in the form of aqueous solutions have generally not been able to satisfy all of the foregoing requirements prior to the present invention.

Aqueous metalworking lubricant compositions are known in the prior art. However, prior to the present invention, aqueous metalworking lubricants were not placed into widespread commercial use because of their inability to satisfy simultaneously each of the requirements listed above.

Beaubien et al. U.S. Pat. No. 2,825,693 claims a metalworking lubricant concentrate comprising about 5–20% each of a block polyoxypropylene-polyoxyethylene copolymer and a random polyoxypropylene-polyoxyethylene copolymer, about 1–12% each of sodium nitrite and ethanolamine, and about 0.01–5% of an unsaturated high molecular weight fatty acid. The block polyoxypropylene-polyoxyethylene copolymers disclosed by Beaubien et al. are conjugated in the order EO-PO-EO ("EO" denotes polyoxyethylene and "PO" denotes polyoxypropylene), rather than being the PO-EO-PO block copolymers of the present invention.

Reamer U.S. Pat. No. 2,981,686 discloses an aqueous metalworking lubricant comprising a water-soluble hetero-copolymer of a mixture of oxyethylene and oxypropylene groups. The Reamer patent states that block copolymers of ethylene oxide and propylene oxide are undesirable in such lubricants because of the tendency of these copolymers to produce "undesirable frictional problems, foaming, instability and the like."

Davis U.S. Pat. No. 3,374,171 claims a cutting fluid containing about 5–40% of a water-soluble alkanolamine, about 0.1–9% of a saturated organic acid having about 6–9 carbon atoms per molecule, and about 0.5–20% of a water-soluble polyoxyalkylene glycol. The Davis patent contains no specific teaching of the utility of PO-EO-PO block copolymers as ingredients of aqueous metalworking compositions. In addition, Davis cautions against the use of higher molecular weight saturated organic acids. He states that such higher organic acids can result in poor hard water stability, reduced corrosion-inhibiting properties and high foaming tendencies. These problems are said to lead to clogged filters, poor rust protection and reduced tool life in areas where hard water is encountered.

Felton U.S. Pat. No. 4,033,886 discloses a liquid suitable for the formation of a recyclable metalworking lubricant. The liquid is an aqueous solution containing a mixture of ethylene oxide-propylene oxide block copolymers, and alkanolamine cinnamate and a boron amine complex. The block copolymers have a central portion of polypropylene oxide with polyethylene oxide on each end (see column 2, lines 32–33).

It is a principal object of the present invention to provide an aqueous metalworking lubricant composition having acceptable load bearing and friction-modifying properties, corrosion-inhibition ability and chemical stability under ordinary operating conditions, and avoidance of deposits on tools and workpieces following metalworking operations in which the composition is used.

It is a related object of the invention to provide a lubricant composition accomplishing the foregoing objectives while at the same time avoiding excessive production of foam.

Additional objects and advantages of the present invention will become apparent to persons skilled in the art from the following specification.

SUMMARY OF THE INVENTION

In accordance with the present invention, there is provided an aqueous synthetic metalworking lubricant having good lubricating properties in metal fabricating operations. The lubricant is especially suitable for use in the hot rolling and cold rolling of aluminum and aluminum alloys into sheet and foil form.

The lubricant comprises a water-soluble mixture of PO-EO-PO block copolymers, a water-soluble carboxylic acid, a water-soluble alkanolamine and water. A preferred lubricant composition also contains an anti-foam agent.

The PO-EO-PO block copolymers comprise about 1.0–20 wt% of the composition. The average molecular weight of polyoxypropylene chains in the mixture is at least 900, and the polyoxyethylene chains constitute about 10–80 wt% of the mixture.

The carboxylic acid comprises about 0.5–10 wt% of the composition and may be a saturated or unsaturated $C_{11}$ to $C_{36}$ mono- or dicarboxylic acid. The acid is preferably a saturated or monounsaturated $C_{12}$ to $C_{20}$ monocarboxylic acid. Two preferred carboxylic acids are oleic acid and lauric acid.

The water-soluble alkanolamine comprises about 0.5–10 wt% of the composition. Some particularly preferred alkanolamines are triethanolamine, diethanolamine and ethyldiisopropanolamine.

DESCRIPTION OF THE PREFERRED EMBODIMENT

The aqueous synthetic metalworking lubricant composition of the invention is suitable for use with both ferrous and non-ferrous metals. The lubricant composition can be used in such operations as rolling, drawing and ironing, machining and others. The lubricant composition exhibits satisfactory load bearing and friction modifying properties when used for either hot rolling or cold rolling of aluminum alloys.

The term "hot rolling" refers to rolling that takes place at a metal entry temperature of approximately 450–1000° F. for aluminum alloys. Hot rolling is typically used to reduce slabs of aluminum alloy material that are several inches thick into sheets having a thickness of about ⅛ inch.

The term "cold rolling" refers to rolling in which metal entry temperature may range from approximately ambient temperature to about 450° F. for aluminum alloys. Metal entry temperature is ordinarily about ambient temperature. Cold rolling is typically used to reduce sheets of aluminum alloy material about ⅛ inch thick into lesser thicknesses.

One ingredient of the lubricant composition is a water-soluble mixture of EO-PO block copolymers containing a single EO chain and two PO chains attached to the EO chain. These block copolymers have the general formula $$HO[\underset{\substack{|\\ CH_3}}{CH_2CHO}]_x[CH_2CH_2O]_y[\underset{\substack{|\\ CH_3}}{CH_2CHO}]_zH.$$

The average molecular weight of PO chains in the mixture is at least 900, and the EO chains in the mixture constitute about 10–80 wt% of the mixture. The average molecular weight of PO chains in the mixture is preferably about 1000 to 3100. In one preferred mixture, the average molecular weight of PO chains in the mixture is about 1700, and EO chains constitute about 20 wt% of the mixture.

Such materials are sold under the trade name "Pluronic R" by BASF Wyandotte Corporation of Wyandotte, Mich. The mixture of block copolymers constitutes about 1.0–20 wt% of the lubricant composition, generally about 2.5–10 wt%. One typical example contains about 5 wt% of a mixture of block PO-EO-PO copolymers wherein the average molecular weight of PO chains in the mixture is about 1700, and the EO chains constitute about 20 wt% of the mixture. This mixture is sold under the trade designation "17R2." The mixture of block copolymers functions as an additive solubilizer, viscosity building and antiwear agent in the lubricant composition.

The PO-EO-PO block copolymers are formed by the sequential addition of ethylene oxide and then propylene oxide to an ethylene glycol base. These conjugated or block copolymers are described in greater detail in Jackson et al. U.S. Pat. No. 3,036,118 issued May 22, 1962. The disclosure of said Jackson et al. patent is incorporated by reference to the extent not inconsistent with the present invention.

A second ingredient of the composition is a water-soluble carboxylic acid having the general formula $$C_mH_{2m-n-r+2}(COOH)_r$$

where m is an integer from 11 to 36, n=0, 2, 4 or 6 and r=1 or 2. The carboxylic acid is preferably a saturated or monounsaturated $C_{12}$ to $C_{20}$ monocarboxylic acid. Two particularly preferred monocarboxylic acids are oleic acid and lauric acid.

An alternative formulation of the lubricant composition includes a dimeric unsaturated fatty acid, such as dilinoleic acid. Dimeric fatty acids are also commercially available as "dimer acids," usually containing a total of about 32 to 36 carbon atoms. These acids result from the dimerization of polyunsaturated fatty acids containing from 16 to 18 carbon atoms. For example, the term "$C_{16}$–$C_{18}$ dimer acids" refers to a commercially available dimerization product of mixed $C_{16}$–$C_{18}$ polyunsaturated fatty acids.

The water-soluble carboxylic acid comprises about 0.5–10 wt% of the composition, preferably about 0.5–5 wt%. Compositions containing about 1–2 wt% of the acid are quite suitable. Two suitable lubricant compositions include 1 wt% oleic acid and 2 wt% oleic acid, respectively. The carboxylic acid functions as a load bearing and friction modifying additive in the composition.

A third ingredient of the composition is a water-soluble alkanolamine. Some suitable alkanolamines are monoethanolamine, diethanolamine, triethanolamine, dimethylethanolamine, diethyl-ethanolamine, aminoethyl-ethanolamine, methyl-diethanolamine, N-acetyl ethanolamine, phenylethanolamine, phenyldiethanolamine, mono-, di- and triisopropanolamine, and mixtures of any of the foregoing alkanolamines. The preferred alkanolamines are triethanolamine, diethanolamine and ethyldiisopropanolamine.

The water-soluble alkanolamine comprises about 0.5–10 wt% of the lubricant composition, preferably about 0.5–3 wt%. Two preferred compositions include 0.8 wt% triethanolamine and 1.6 wt% triethanolamine, respectively. The alkanolamine has the function of partially or completely converting the carboxylic acid into amine soap. The alkanolamine should preferably be present in sufficient concentration that at least one amine group is present for each carboxyl group in the carboxylic acid.

In the preferred form, the lubricant composition of the invention also contains a defoaming agent. One preferred composition contains about 50–100 ppm (about 0.005–0.01 wt%) of a non-silicone defoaming agent. This agent comprises organic and silica derivatives dispersed in a solvent and is sold commercially by Mazer Chemicals Inc. of Gurnee, Ill. as its MAZU DF 2502 defoamer. A less preferred lubricant composition comprises about 25 ppm (about 0.0025 wt%) of a silicone defoaming agent. The defoaming agent is chosen so as to produce suitable reductions in foam while at the same time avoiding deposits on metal surfaces that affect coating or paint adhesion.

The lubricant composition may also include about 0.5–10 wt% of a water-soluble polyoxyethylene or polyoxypropylene alcohol or a water-soluble carboxylic acid ester of such alcohol. Two suitable esters are a monostearate of a polyethylene glycol having a molecular weight of about 400, and a dioleate of a polyethylene glycol having a molecular weight of about 1000. These esters are typically added to form about 1 wt% of the lubricant composition. The esters add to lubricity of the composition.

Additional additives known to persons skilled in the art may be desirable under certain conditions. Such additives may include biocides, oxidation inhibitors and corrosion inhibitors.

EXAMPLES

Some examples of preferred lubricant compositions made in accordance with the invention are as follows:

| Example | Ingredient | Content (wt %) |
|---|---|---|
| 1 | A mixture of polyoxypropylene-polyoxyethylene-polyoxypropylene block copolymers in which the average molecular weight of the polyoxypropylene chains is about 1700 and the polyoxyethylene chains constitute about 20 wt % of the mixture (Pluronic 17R2) | 10 |
| | Oleic acid | 2 |
| | Triethanolamine | 1.6 |
| | Non-silicone defoamer (MAZU DF 2502) | 50–100 ppm |
| | Water | Remainder |
| 2 | A mixture of polyoxypropylene-polyoxyethylene-polyoxypropylene block copolymers in which the average molecular weight of the polyoxypropylene chains is about 1700 and the polyoxyethylene chains constitute about 20 wt % of the mixture (Pluronic 17R2) | 5 |
| | Oleic acid | 1 |
| | Triethanolamine | 0.8 |
| | Non-silicone defoamer (MAZU DF 2502) | 50–100 ppm |
| | Water | Remainder |
| 3 | A mixture of polyoxypropylene-polyoxyethylene-polyoxypropylene block copolymers in which the average molecular weight of the polyoxypropylene chains is about 1700 and the polyoxyethylene chains constitute about 20 wt % of the mixture (Pluronic 17R2) | 10 |
| | Dimer acid | 2 |
| | Triethanolamine | 2.4 |
| | Polyethylene glycol (400) monostearate | 1 |
| | Non-silicone defoamer (MAZU DF 2502) | 50–100 ppm |
| | Water | Remainder |
| 4 | A mixture of polyoxypropylene-polyoxyethylene-polyoxypropylene block copolymers in which the average molecular weight of the polyoxypropylene chains is about 2500 and the polyoxyethylene chains constitute about 40 wt % of the mixture (Pluronic 25R4) | 5 |
| | Lauric acid | 1 |
| | Ethyldiisopropanolamine | 2 |
| | Polyethylene glycol (1000) Dioleate | 1 |
| | Non-silicone defoamer (MAZU DF 2502) | 50–100 ppm |
| | Water | Remainder |
| 5 | A mixture of polyoxypropylene-polyoxyethylene-polyoxypropylene block copolymers in which the average molecular weight of the polyoxypropylene chains is about 3100 and the polyoxyethylene chains constitute about 10 wt % of the mixture (Pluronic 31R1) | 10 |
| | Oleic acid | 2 |
| | Triethanolamine | 0.5 |
| | Diethanolamine | 1 |
| | Defoamer (MAZU DF 2502) | 50–100 ppm |
| | Water | Remainder |
| 6 | A mixture of polyoxypropylene-polyoxyethylene-polyoxypropylene block copolymers in which the average molecular weight of the polyoxypropylene chains is about 2500 and the polyoxyethylene chains constitute about 50 wt % of the mixture (Pluronic 25R5) | 5 |

-continued

| Example | Ingredient | Content (wt %) |
|---|---|---|
| | Oleic acid | 0.5 |
| | Dimer acid | 0.5 |
| | Triethanolamine | 1 |
| | Defoamer (MAZU DF 2502) | 50–100 ppm |
| | Water | Remainder |
| 7 | A mixture of polyoxypropylene-polyoxyethylene-polyoxypropylene block copolymers in which the average molecular weight of the polyoxypropylene chains is about 3100 and the polyoxyethylene chains constitute about 40 wt % of the mixture (Pluronic 31R4) | 7 |
| | Oleic acid | 2 |
| | Aminoethyl-ethanolamine | 1 |
| | Polyethylene glycol (600) monolaurate | 1 |
| | Defoamer (MAZU DF 2502) | 50–100 ppm |
| | Water | Remainder |
| 8 | A mixture of polyoxypropylene-polyoxyethylene-polyoxypropylene block copolymers in which the average molecular weight of the polyoxypropylene chains is about 1700 and the polyoxyethylene chains constitute about 40 wt % of the mixture (Pluronic 17R4) | 10 |
| | Isostearic acid | 3 |
| | Diethanolamine | 1 |
| | Polyoxyethylene (12) lauryl ether | 1 |
| | Non-silicone defoamer (MAZU DF 2502) | 50–100 ppm |
| | Water | Remainder |
| 9 | A mixture of polyoxypropylene-polyoxyethylene-polyoxypropylene block copolymers in which the average molecular weight of the polyoxypropylene chains is about 1000 and the polyoxyethylene chains constitute about 50 wt % of the mixture (Pluronic 10R5) | 10 |
| | Isostearic acid | 2 |
| | Diethanolamine | 1 |
| | Non-silicone defoamer (MAZU DF 2502) | 50–100 ppm |
| | Water | Remainder |
| 10 | A mixture of polyoxypropylene-polyoxyethylene-polyoxypropylene block copolymers in which the average molecular weight of the polyoxypropylene chains is about 1700 and the polyoxyethylene chains constitute about 80 wt % of the mixture (Pluronic 17R8) | 7 |
| | Oleic acid | 2 |
| | Triethanolamine | 1.6 |
| | Defoamer (MAZU DF 2502) | 50–100 ppm |
| | Water | Remainder |
| 11 | A mixture of polyoxypropylene-polyoxyethylene-polyoxypropylene block copolymers in which the average molecular weight of the polyoxypropylene chains is about 2500 and the polyoxyethylene chains constitute about 10 wt % of the mixture (Pluronic 25R1) | 5 |
| | Linoleic acid | 1 |
| | Monoethanolamine | 0.5 |
| | Defoamer (MAZU DF 2502) | 50–100 ppm |
| | Water | Remainder |
| 12 | A mixture of polyoxypropylene-polyoxyethylene-polyoxypropylene block copolymers in which the average molecular weight of the polyoxypropylene chains is about 3100 and the polyoxyethylene chains constitute about 20 wt % of the mixture (Pluronic 31R2) | 7.5 |
| | Oleic acid | 4 |
| | Diethanolamine | 1.5 |
| | Non-silicone defoamer | 50–100 ppm |

-continued

| Example | Ingredient | Content (wt %) |
|---|---|---|
| | (MAZU DF 2502) | |
| | Water | Remainder |
| 13 | A mixture of polyoxypropylene-polyoxyethylene-polyoxypropylene block copolymers in which the average molecular weight of the polyoxypropylene chains is about 1000 and the polyoxyethylene chains constitute about 50 wt % of the mixture (Pluronic 10R5) | 5 |
| | Lauric acid | 1.5 |
| | Monoethanolamine | 1 |
| | Polyethylene glycol (4000) distearate | 1 |
| | Non-silicone defoamer (MAZU DF 2502) | 50–100 ppm |
| | Water | Remainder |
| 14 | A mixture of polyoxypropylene-polyoxyethylene-polyoxypropylene block copolymers in which the average molecular weight of the polyoxypropylene chains is about 1700 and the polyoxyethylene chains constitute about 20 wt % of the mixture (Pluronic 17R2) | 10 |
| | Isostearic acid | 1 |
| | Lauric acid | 1 |
| | Diethanolamine | 1.5 |
| | Polyethylene glycol (400) monolaurate | 1 |
| | Defoamer (MAZU DF 2502) | 50–100 ppm |
| | Water | Remainder |

The lubricant composition of the present invention has been found to exhibit surprisingly good properties when used for either hot rolling or cold rolling of aluminum alloys.

The foregoing description of my invention has been made with reference to a few preferred embodiments. Persons skilled in the art will understand that numerous changes and modifications can be made in the invention without departing from the spirit and scope of the following claims.

What is claimed is:

1. A lubricant composition comprising (a) about 1.0–20 wt% of a water-soluble mixture of polyoxyethylene-polyoxypropylene block copolymers containing a single polyoxyethylene chain and two polyoxypropylene chains attached to the polyoxyethylene chain, the average molecular weight of the polyoxypropylene chains in the mixture being at least 900 and the polyoxyethylene chains in the mixture constituting about 10–80 wt% of the mixture;

(b) about 0.5–10 wt% of a water-soluble carboxylic acid of the general formula $$C_mH_{2m-n-r+2}(COOH)_r$$

where m is an integer from 11 to 36, n=0, 2, 4 or 6 and r=1 or 2;

(c) about 0.5–10 wt% of a water-soluble alkanolamine; and (d) remainder, water.

2. The lubricant composition of claim 1 wherein the average molecular weight of polyoxypropylene chains in the mixture is about 1000 to 3100.

3. The lubricant composition of claim 1 wherein the polyoxyethylene chains in the mixture constitute about 20 wt% of the mixture.

4. The lubricant composition of claim 1 wherein the mixture of polyoxyethylene-polyoxypropylene block copolymers comprises about 2.5–10 wt% of the composition.

5. The lubricant composition of claim 4 wherein the mixture of polyoxyethylene-polyoxypropylene block copolymers comprises about 5 wt% of the composition.

6. The lubricant composition of claim 1 wherein said carboxylic acid comprises a saturated or monounsaturated $C_{12}$ to $C_{20}$ monocarboxylic acid.

7. The lubricant composition of claim 6 wherein said carboxylic acid comprises oleic acid or lauric acid.

8. The lubricant composition of claim 1 wherein said carboxylic acid comprises about 0.5–5 wt% of the composition.

9. The lubricant composition of claim 8 wherein said carboxylic acid comprises about 1–2 wt% of the composition.

10. The lubricant composition of claim 1 wherein said alkanolamine is selected from the group consisting of triethanolamine, diethanolamine and ethyldiisopropanolamine.

11. The lubricant composition of claim 10 wherein said alkanolamine is triethanolamine.

12. The lubricant composition of claim 1, further comprising (e) an antifoam agent.

13. The lubricant composition of claim 12 wherein said antifoam agent comprises about 50–100 ppm of the composition.

14. The lubricant composition of claim 1, further comprising (f) about 0.5–10 wt% of a water-soluble polyoxyethylene or polyoxypropylene alcohol or a water-soluble carboxylic acid ester of a polyoxyethylene or polyoxypropylene alcohol.

15. The lubricant composition of claim 14 wherein said alcohol or ester comprises about 1 wt% of the composition.

16. A metalworking lubricant composition suitable for hot rolling of aluminum and aluminum alloy material at a temperature of about 450–1000° F., said composition also being suitable for cold rolling of aluminum and aluminum alloy material, said composition comprising (a) about 1.0–20 wt% of a water-soluble mixture of polyoxyethylene-polyoxypropylene block copolymers containing a single polyoxyethylene chain and two polyoxypropylene chains attached to the polyoxyethylene chain, the average molecular weight of the polyoxypropylene chains in the mixture being about 1000 to 3100 and the polyoxyethylene chains in the mixture constituting about 10–80 wt% of the mixture;

(b) about 0.5–10 wt% of a saturated or monounsaturated $C_{12}$ to $C_{20}$ monocarboxylic acid;

(c) about 0.5–10 wt% of a water-soluble alkanolamine;

(d) an antifoam agent; and (e) remainder, water.

17. The metalworking lubricant composition of claim 16 wherein said antifoam agent comprises about 50–100 ppm of the composition.

18. The metalworking lubricant composition of claim 16 wherein the mixture of polyoxyethylene-polyoxypropylene block copolymers comprises about 2.5–10 wt% of the composition.

19. The metalworking lubricant composition of claim 16 wherein the average molecular weight of the polyoxypropylene chains in the mixture is about 1700.

20. The metalworking lubricant composition of claim 16 wherein the polyoxyethylene chains in the mixture constitute about 20 wt% of the mixture.

* * * * *